United States Patent [19]

Mercey et al.

[11] Patent Number: 4,509,505

[45] Date of Patent: Apr. 9, 1985

[54] ISOLATOR FOR CONFINING AND TRANSPORTING HUMAN BEINGS IN A STERILE ATMOSPHERE

[75] Inventors: Gilles Mercey, Vendome; Claude Picard, Nanterre; Bernard Saint-Martin, Paris, all of France

[73] Assignee: La Calhene Societe Anonyme, France

[21] Appl. No.: 474,717

[22] Filed: Mar. 10, 1983

[30] Foreign Application Priority Data

Mar. 12, 1982 [FR] France ..... 82 04199

[51] Int. Cl.[3] ..... A61G 11/00

[52] U.S. Cl. ..... 128/1 B

[58] Field of Search ..... 128/1 B, 1 R, 203.26, 128/204.17

[56] References Cited

U.S. PATENT DOCUMENTS

| | | | |
|---|---|---|---|
| 1,900,342 | 3/1933 | Hess | 128/1 B |
| 2,243,999 | 6/1941 | Chapple | 128/1 |
| 2,633,842 | 4/1953 | Higgs | 128/1 B |
| 3,076,451 | 2/1963 | Stoner | 128/1 B |
| 3,338,233 | 8/1967 | Grosholz et al. | 128/1 B |
| 3,529,590 | 9/1970 | Grosholz | 128/1 |
| 4,328,793 | 5/1982 | Martin | 128/1 B |

FOREIGN PATENT DOCUMENTS

| | | |
|---|---|---|
| 492608 | 12/1949 | Belgium . |
| 2925192 | 1/1981 | Fed. Rep. of Germany . |
| 2944508 | 5/1981 | Fed. Rep. of Germany . |
| 999826 | 7/1965 | United Kingdom . |
| 1088573 | 10/1967 | United Kingdom . |
| 1092164 | 11/1967 | United Kingdom . |

*Primary Examiner*—Edward M. Coven

*Attorney, Agent, or Firm*—Dennis P. Clarke

[57] ABSTRACT

Isolator for confining and transporting in a sterile atmosphere human beings and in particular babies, comprising a tight enclosure, ventilated by a forced fresh air circulation circulated by a first fan through an absolute inlet filter and an absolute outlet filter, rapid transfer devices which are sealed from the outside, tight intervention devices, certain of which form an integral part of the enclosure wall, wherein it comprises, between the fresh air inlet and outlet, a branch equipped with a second fan and a variable temperature heater element, said temperature being automatically limited to a maximum value of approximately 120° C., so as to produce heating and setting to a reference temperature of the internal atmosphere by the partial recycling thereof, all the energy necessary for the operation of the installation being provided by an autonomous accumulator battery, which can be that of the transportation vehicle.

8 Claims, 4 Drawing Figures

ISOLATOR FOR CONFINING AND TRANSPORTING HUMAN BEINGS IN A STERILE ATMOSPHERE

BACKGROUND OF THE INVENTION

The present invention relates to the transportation in a sterile atmosphere of human beings who, for medical reasons, have to be confined in a sterile atmosphere and transferred from one place to another within the same hospital, or even over a distance of several dozen or hundred kilometers, which consequently involves transportation in an autonomous vehicle (aircraft, helicopter, car), without there being any break in the seal and sterility of the medium in which they are housed, whereby it is impossible to give them even emergency medical treatment. This is particularly the case with persons who have, at least temporarily, lost all or part of their immunological defences, as well as certain premature babies, who often have to travel long distances to ensure appropriate survival treatment.

In the case of babies, which represent the preferred, but non-exclusive field of application of the invention, it is necessary to use incubators which must theoretically protect these babies against three essential factors, namely bacterial contamination, relative humidity and temperature. Experience has unfortunately shown that the protection which is actually obtained against these three factors is very illusory for the reasons indicated hereinafter.

With regards to bacteriological contamination, the confinement offered by an incubator, which is really only an enclosure sealed by a cover, is not tight because any intervention on the baby involves the opening of the enclosure. This in itself limits to the absolute minimum any intervention during transportation, whilst it is necessary to sterilize the interior of the vehicle in which transportation takes place, which may be impossible and certainly cannot take place rapidly, when there is a need for emergency transportation.

Certain babies require a higher than normal relative humidity from the pulmonary standpoint. They may also require an ambient temperature of up to 37° C. A combination of these two physical conditions provides a climate which is particularly favourable for bacterial growth.

With regards to the temperature, relatively sudden variations often occur in incubators, even when they are thermostatically controlled, because the need to open the cover a certain number of times on each occasion involves an inflow of a by no means negligible volume of fresh air, which causes a sudden temperature drop. In certain cases, these variations can be very unpleasant for the baby (stress phenomenon).

In connection with medical intervention in a fixed station and with a confined atmosphere, isolators are also known, which make it possible to completely biologically separate a patient from the exterior, whilst communicating with him in both directions (introduction and removal of objects or equipment) with the aid of tight transfer or intervention devices, such as gloves and the like, whilst others can at least partly form an integral part of the enclosure wall. An enclosure of this type is generally ventilated by an air circuit between an inlet and an outlet, each of which has an absolute filter, which stops the entry or exit of any bacteria. Whenever necessary, such an enclosure with its filters can be very easily sterilized by a microbicidal agent circulating in the ventilation circuit for a certain period, such as e.g. peracetic acid.

Such isolators and their intervention devices have been described, particularly on pp.121 to 125 of No. 284 of the Feb. 1979 issue of the Journal Labo Pharma, pp.227 to 230 of Vol.3 of the 1978 edition of Science et Techniques des Animaux de Laboratoires, as well as French Pat. No. 8,003,067, filed on Feb. 12 1980 by the Applicant Company.

Consideration can obviously be given to the use of such isolators for transporting human beings in a sterile atmosphere, but almost immediately a virtually insurmountable difficulty is encountered, namely that of the heating power for such an isolator operating in open circuit. Thus, experience has shown that to heat and maintain at around 37° a human isolator in an ambient of 20° C. and traversed by a fresh air flow of 10 $m^3/h$, it is necessary to have an electrical power of 680 W and approximately 90 minutes are required to raise the temperature. Although this can be achieved easily for a fixed station use, where electrical mains are available, it is difficult to realise on board a vehicle through the use of a conventional accumulator battery, even if the latter is permanently recharged by the vehicle alternator. It must be borne in mind that such transportations frequently take place in emergencies using vehicles of the ambulance type which, by their very nature, are large energy consumers, not only for heating, but also for headlights, revolving lights and sirens. Even when the accumulator batteries of such vehicles are supplied by a dynamo or alternator connected to the engine, they have a tendency to rapidly discharge and could not therefore ensure a transportation lasting several hours, whilst supplying such a high complementary power.

SUMMARY OF THE INVENTION

The invention relates to an isolator for the confinement and transportation in a sterile atmosphere of human beings making it possible to solve the aforementioned problems by exclusively using an accumulator battery for the overall operation.

This isolator is of the type comprising in perse known manner, a tight enclosure, ventilated by a forced fresh air circulation circulated by a first fan through an absolute inlet filter and an absolute outlet filter, rapid transfer devices which are sealed from the outside, tight intervention devices, certain of which form an integral part of the enclosure wall, wherein it comprises, between the fresh air inlet and outlet, a branch equipped with a second fan and a variable temperature heater element, said temperature being automatically limited to a maximum value of approximately 120° C., so as to produce reheating and setting to a reference temperature of the internal atmosphere by the partial recycling thereof, all the energy necessary for the operation of the installation being provided by an autonomous accumulator battery, which can be that of the transportation vehicle.

The fact that, according to the invention, a per se known tight enclosure or isolator is equipped with two parallel ventilation circuits, namely a fresh air circuit for the breathing of the patient and a heating recycling circuit, makes it possible to reduce to a minimum heat losses thereby limiting to about 100 watts the electrical power for ensuring the operation of the installation. Moreover, the use of a tight enclosure equipped with inlet and outlet filters simultaneously makes it possible to retain all the advantages of this type of isolator referred to hereinbefore, particularly the transfer from one medical care station to another, long distance transportation, the introduction and removal of miscellaneous objects and direct intervention through the enclosure wall.

Furthermore, the automatic limitation to a maximum value of approximately 120° C., but frequently 80° or 90° C. of the variable temperature heater element obviates any need for any glowing red of elements in the circuit for recycling the internal atmosphere of the enclosure, which is fundamental, particularly where, for biological reasons, the internal atmosphere is oxygen-enriched and could lead to by no means negligible ignition risks in the case of a leak. The tight enclosure equipped in this way with its ventilation and recycling circuits can be moved at random on a simple trolley having an autonomous accumulator battery ensuring its independence during the various transfers e.g. within the same hospital. As soon as transportation by vehicle is necessary, it is possible, as desired, either to retain the same accumulator battery from which a complementary contribution of approximately 100 W is required, or to use the vehicle battery.

The isolator according to the invention has the important advantage of permitting the transfer and transportation from one sterile chamber to another, located at a distance of several hundred kilometers, without there ever being a break in the sealing and biological sterility of the atmosphere in which the patient is confined. In addition, this takes place whilst administering to him in a continuous manner the medicaments and the like which he may need.

According to another feature of the isolator according to the invention, the rotational speeds of the first and second fans are maintained at preselected constant values, and the reference temperature of the enclosure atmosphere is obtained by regulating the temperature of the heater element simultaneously with the aid of on the one hand a basic control taking account of the variation between the external and the reference temperatures and the operative or inoperative state of the first fan, and on the other hand a complementary fine feedback loop, whose error signal is processed on the basis of the variation between the internal and reference temperatures.

The decision to maintain the fresh air and recycling atmosphere fans at constant rotational speeds is due to a need for simplification because, in a vehicle, it is easier to modify the heating by means of a control system. Moreover, these per se known fans only require a very low power level of e.g. 8 W for a flow rate of several cubic meters per hour.

With regards to the heating and temperatureregulation of the tight enclosure, it results from the fact that for an installation of this type, the heat loss is approximately proportional to the difference between the reference temperature and the external ambient temperature. It is for this reason that, by using a basic control, heating takes place to a temperature close to the desired reference value and it is completed by a complementary fine feedback loop, whose action is dependent on the variation at all times between the reference temperature and the true temperature prevailing within the enclosure. Under these conditions, this complementary loop only has to supply the extra overheating or underheating required to obtain the precise reference temperature on the basis of the approximately correct temperature obtained by the basic control.

According to another interesting feature of the preset invention, the heater element located in the recycling branch is constituted by power transistors traversed by a current regulated by the basis control and the feedback loop and whose cooling blades are immersed in the air recycling system.

According to the invention, the heater element is also equipped with thermistors, which vary with the temperature and which, if necessary, automatically reduce the current in the power transistors, so as to limit the temperature of the heater element to a maximum value of approximately 120° C.

This construction of the heater element obviates the presence of red points or sparks, which could occur with ordinary electric resistors and would lead to serious risks in the case where oxygen therapy was necessary for the transported patient. Furthermore, the thermistors making it possible to limit the temperature to a maximum value of approximately 80° to 120° C. also represents a safety factor with respect to the fire risks, as well as risks of overheating the enclosure.

Finally, the isolator according to the invention may also have within the tight enclosure, a respirator supplied from the outside and which non-sealingly covers the patient's head, in order to condition the nature and/or the relative humidity of the atmosphere which he breathes, the consumed part of said atmosphere being at least partly directly transferred into the enclosure.

By means of its autonomous supply sealingly traversing the enclosure walls, this respirator provides a virtually independent respiratory supply for the patient. It is very useful in all cases where it is desired to supply the patient with a special respiratory mixture and particularly for oxygen therapy sessions. It also provides an easy and advantageous solution to the problem of the relative humidity of the gaseous atmosphere breathed by babies. This respirator can be easily placed on the patient's head without any special sealing. The patient directly transfers into the tight enclosure part of the thus supplied gas or moisture, which is not disadvantageous from the relative humidity standpoint, because the portion of the gaseous atmosphere transferred into the enclosure always remains very low and is diluted in the overall stream.

BRIEF DESCRIPTION OF THE DRAWINGS

The invention is described in greater detail hereinafter relative to a non-limitative embodiment of an isolator for the transportation of human beings in a sterile atmosphere, with reference to the attached drawings and in particular FIGS. 1 to 3, wherein show.

DETAILED DESCRIPTION OF THE INVENTION

Figure 1:
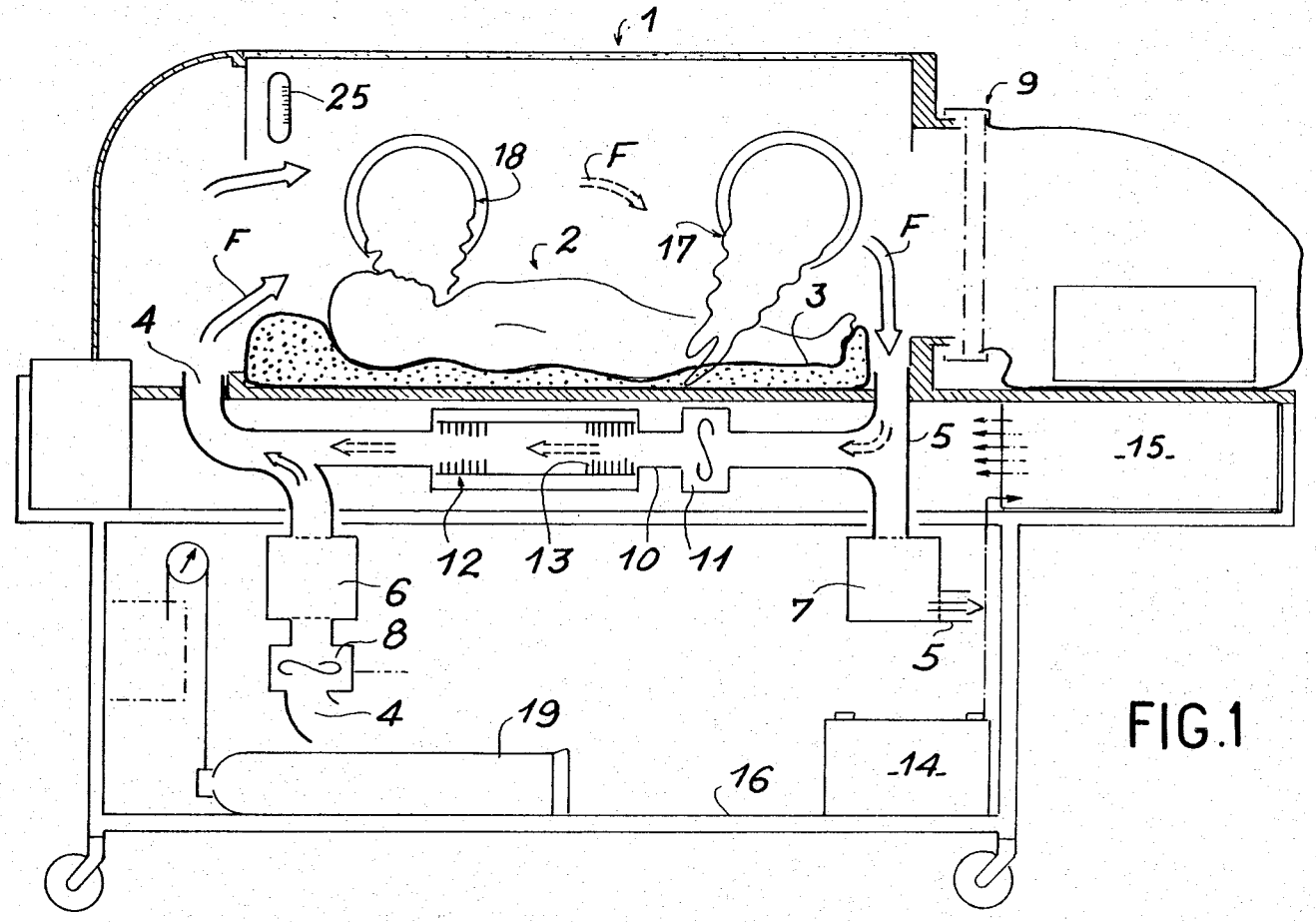
FIG. 1 a general diagrammatic view in elevation of an isolator according to the invention, provided with certain operating accessories.

In FIG. 1, it is possible to see a tight enclosure or isolator 1 of a per se known type and intended for the transportation of a baby 2. In the present embodiment, the enclosure 1 has a volume of 120 liters. In this particular case, the baby 2 rests on a vacuum mattress or cushion 3 of a per se known type and a formed from a certain number of small diameter plastic balls enclosed in a flexible envelope and tight when a vacuum is produced. Such a mattress is very useful for moulding the shape of the patient's body, in order to support and maintain him in position during acceleration changes during transportation.

In per se known manner, tight enclosure 1 has a fresh air inlet pipe 4 and a spent air outlet pipe 5 on which are respectively located the absolute filters 6 and 7, whose perforation size is chosen in such a way that they are able to prevent any bacterial transfer. In front of filter 6, in pipe 4 is positioned the blade of the first fan 8, whose motor and electrical control are not shown and which ensures the circulation of fresh air to be breathed by the baby 2 in enclosure 1. The power of this fan is approximately 8 W and within enclosure 1 ensures a circulation of fresh air at a constant flow rate of approximately 3 $m^3/h$. A double-door, tight transfer system 9, of per se known type, e.g. from French Patent No. 69/10571 of Apr. 4 1969, makes it possible to rapidly introduce and remove with respect to enclosure 1 all necessary accessories and means witout breaking the seal of the installation.

According to the invention, a recycling branch 10 positioned between inlet pipe 4 and outlet pipe 5, has a second fan 11 and a heater element 12 permitting the recycling of a constant flow of approximately 9 $m^3/h$ of the atmosphere contained in enclosure 1, whilst heating it in contact with the heating blades 13 of heater element 12.

The complete isolator described in FIG. 1 is made autonomous from the energy standpoint, as a result of a conventional accumulator battery 14, which supplies all the fans 8 and 11 and the heater element 12 via an overall electrical control system 15, whereof certain details will be described hereinafter with reference to FIG. 3. The system is carried by a moving trolley 16 and can, either move in an autonomous manner within e.g. the same hospital, or can be placed on board an ambulance, which does not have to be disinfected beforehand.

The walls of the tight enclosure 1 also have intervention devices forming part of said wall, e.g. gloves 17 and 18. The transportation trolley 16 can also carry various useful medical accessories, such as e.g. supply probes and the oxygen cylinder 19 used for supplying the respirator 20 covering the head of the transported baby 2. In a per se known manner, all these accessories can be manipulated and used as a result of the double-door system 9 and the handling gloves 17, 18, without at any time breaking the confinement of the tight enclosure 1.

The energy economies obtained on the isolator according to the invention can be further increased by providing at locations where there is no need to see what is happening in the enclosure, a double wall, in which is introduced glass wool, which is an excellent thermal insulant. Furthermore, during transportation, it is possible to place on the installation a shell, which envelopes the entirety and is itself constructed in the form of a double plastic envelope containing the glass wool. This makes it possible to still further increase the thermal insulation and reduce losses, either during the heating of the enclosure before introducing the patient, or during transportation, when there is no need for doctors to intervene. This not shown shell can also be provided with observation windows, which makes it possible to supervise the baby.

In general, the operation of the isolator shown in FIG. 1 is as follows. Before introducing the patient, the enclosure is sterilized. This is performed in per se known manner, as described e.g. in French Pat. No. 8,003,067 of the Applicant Company, using a flow of peracetic acid, which destroys all living germs, not only in enclosure 1, but also in the pipes supplying it and in the absolute filters 6, 7. This circulation, as well as the following fresh air scavenging are carried out with the aid of fan 8 and pipes 4 and 5.

When this first operation has been completed, enclosure 1 is preheated preferably by using the mains or, if no mains are available, battery 14. To carry out this preheating, fan 11 and the recycling circulation in pipe 10 are started. Fan 11 which, for simplicity reasons, has only a single rotational speed, supplies approximately 9 $m^3/h$ for an enclosure 1 with a volume of approximately a 120 liters. This flow of 9 $m^3/h$ results from a choice based on the optimum value for ensuring both a minimum heat energy transfer from heater element 12 to enclosure 1 and for at the same time preventing an excessive stirring up of the air in enclosure 1, which could lead to excessive heat losses.

When this heating has taken place, the patient 2 can be introduced through the tight double door 9. It is then indispensable to start up fan 8 located on air pipe 4 in order to move the fresh breathing air up to patient 2 (arrows F). Fan 8 also rotates at a constant speed and, in this particular case, ensures an hourly flow rate of approximately 3 $m^3/h$. This figure has been retained as a result of an optimization as a function of three essential criteria of permitting normal breathing, retaining the homogenization of the atmosphere of enclosure 1 and finally ensuring an adequate dilution of the surplus oxygen present in this atmosphere. Thus, when the patient receives an oxygen-enriched breathing mixture through his respirator 20, for reasons of safety in connection with explosion hazards, the oxygen proportion must never exceed 28% by volume.

An isolator of the type described relative to FIG. 1 operates in a completely autonomous manner on a battery 14 from which is required a total power of approximately 100 W. Thus, it permits long distance transportation (several hundred kilometers) in ambulances or vehicles, which have no need of being of a special type or of being prepared in advance. With this type of equipment, it is possible to obtain a temperature variation of 30° C. between the temperature of tight enclosure 1 and the external temperature, which is of considerable interest in countries having a very cold winter, such as Canada or the USSR and where hitherto, it was very difficult to transport the patients over long distances in an autonomous manner. Obviously, the biological protection of the patient is maintained throughout transportation, due to the action of filters 5 and 6.

Figure 2:
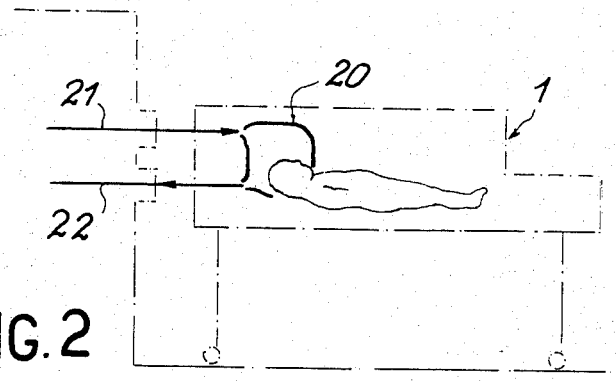
FIG. 2 the detail of fitting a respirator to a transported patient.

FIG. 2 shows details of the use of a respirator 20 on the head of a patient 2, when need arises. For this purpose, an inlet pipe 21 and an outlet pipe 22 for the respiratory gas sealingly traverses the enclosure wall and enters the respirator 20, which is simply placed without any sealing on the patient's head and the patient can consequently transfer part of the breathed in atmosphere into the internal atmosphere of enclosure 1. As explained hereinbefore, this respirator 20 makes it possible to choose a respiratory atmosphere having a particular desired composition and to regulate the relative humidity of the said atmosphere.

Figure 3:
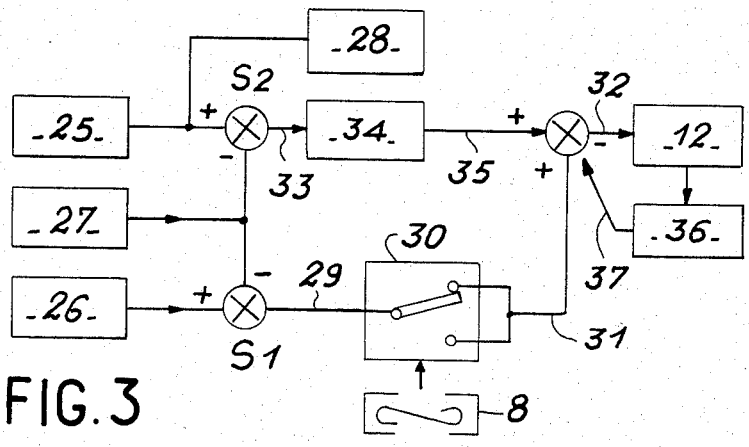
FIG. 3 a circuit diagram of the system for controlling the isolator heater element.

FIG. 3 diagrammatically shows the heating control for enclosure 1. It is possible to see internal 25 and external 26 temperature sensors. The desired reference temperature for the interior of enclosure 1 is displayed on the temperature control means 27. The internal temperature 25 is displayed on an external thermometer 28, which makes it possible for the doctor supervising the patient to have details on this temperature at all times.

A first adder $S_1$ forms the temperature error signal between the displayed reference temperature 27 and the outside temperature 26. It supplies a first signal which, after passing through corrector 30, supplies one of the three inputs 31 of adder $S_3$. Corrector 30 has two positions, as a function of the inoperative or operative state of the fresh air circulation fan 8. When fan 8 is stopped, the error signal present at 29 is transmitted to adder $S_3$, whereas when fan 8 is operating at its nominal speed, the signal present at 29 is multiplied before being transmitted on line 31 by a fixed factor, which takes account of the constant cooling introduced into enclosure 1 by the fresh air flow. Thus, circuit 29, 30, 31 realises the basic control which, via adder $S_3$ at its output 32 to heater element 12, a basic regulation of element 12 enabling the temperature in enclosure 1 to be approximated to the reference value displayed in 26.

According to the invention, a fine complementary feedback loop makes it possible to complete the regulation of heater element 12 in the following way. A second error signal formed from the variation between the reading of the internal sensor 25 and the temperature control 27 is processed in adder $S_2$ and transmitted on line 33 through a corrector 34 to the input 35 of adder $S_3$. Finally, a thermal safety device 36 constituted by variable thermistors and connected to heater element 12 transmit on line 37 to adder $S_3$ information regarding the possible exceeding of the limited limit temperature for heater element 12 and which is generally approximately 80° to 120° C. These details on line 37 are obtained by subtracting in adder $S_3$ signals present at inputs 31, 35, so as to reduce the control 32 of the heater element 12 and lower its temperature. Thus, at its three inputs 31, 35, 37, adder $S_3$ receives control signals coming respectively from the basic control, the complementary feedback loop and the thermal safety device 36, in order to finally process at its output 32, the control of the current used for heating heater element 12.

In order to illustrate the significance and operation of the control device of FIG. 3, hereinafter a numerical example will be given, which will give a better understanding of the respective actions of the basic control and the feedback loop.

In an installation like that of FIG. 1, it is possible to accept natural energy losses of 5 W/° C. temperature variation between the inside and outside of tight enclosure 1.

Thus, on accepting an internal reference temperature of 38° C. with an ambient temperature of 20° C., the variation between these two temperatures is 18° C., which means that it is necessary to have a power of $5 \cdot 18 = 90$ W to maintain the temperatures at the aforementioned values.

We will firstly assume that only feedback loop 3 is in action. Its control gain in the aforementioned example is approximately 50 W/° C., i.e. for each degree of variation between sensor 25 and the reference temperature control 27, it produces by adder $S_3$ a signal developing 50 W of heating in element 12. Under these conditions, for developing the 90 W necessary for heating the enclosure, it is necesssary to have an error signal of $90:50 = 1.8$° C., which means that the real temperature in enclosure 1 would be $18 - 1.8 = 16.2$° C.

On then adding the control loop 29, 30, 31, whose gain is approximately 4 W/° C., this loop will control the power of $4 \cdot 18 = 72$ W.

Under these conditions, the feedback loop will only operate for the control of $90 - 72 = 18$ W and the temperature variation between the reference temperature and the internal temperature will only be $18:50 = 0.36$° C., leading to an internal regulation to a value of $38 - 0.36 = 37.64$° C., the temperature variation between the internal temperature and the reference temperature having consequently passed from 1.8 to 0.36° C.

Thus, it is clear that the more efficient and accurate control loop 29, 30, 31 in making the temperature and power correspond, the better the overall regulation.

Figure 4:
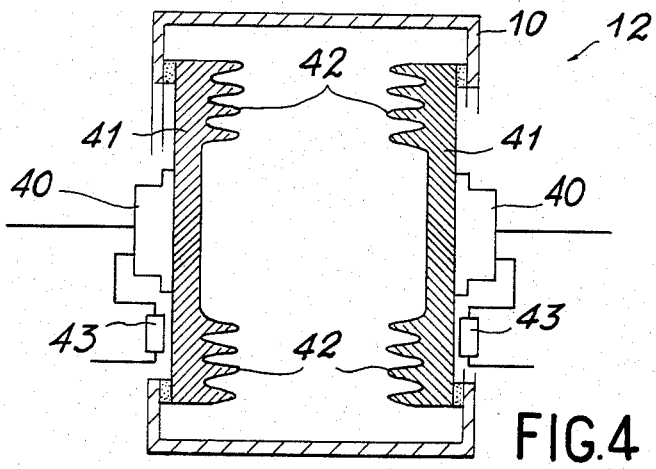
FIG. 4 the system of power transistors used for forming the isolator heater element.

Finally, FIG. 4 shows one of the possible diagrams for the heater element 12 in the air recycling pipe 10 for the tight enclosure 1. In this embodiment, a certain number of power transistors 40, mounted on plates 41 are provided with cooling blades 42. Each transistor 40 is supplied across its polarization resistor 43. Plates 41 are arranged in facing pairs in pipe 10 of which they form part of the walls and the blades 42, subject to the action of the recycling air circulating in pipe 10 are used for dissipating the heat produced by the passage within transistors 40 of the current determined by the basic control of the feedback loop. Locally and within each of the boxes which contain the transistors 40 can at certain points heat internally to approximately 200° C., but the temperatures of the corresponding boxes do not exceed 120° C., because the protective thermistors mounted on the transistors 40 prevent the temperature outside the boxes from exceeding 120° C., as has been explained hereinbefore with reference to FIG. 3. The advantage of the embodiment of FIG. 4 is that the plates 41, provided with their power transistors 40 and cooling blades 42 are elements which are commercially available and which can be fitted to a pipe 10 for forming the desired power heater element 12.

Thus, heater element 12 corresponds to all the criteria with regards to the low temperature energy dissipation and the absence of red points which can lead to fires imposed by the safety of use of installations according to the invention.

The figures given hereinbefore show that the 90 W necessary for the operation of this installation make it possible to use a vehicle battery, when transportation is taking place within the same, without causing any particular problem if it permanently recharged from the energy taken from the operation of the vehicle engine.

What is claimed is:

1. An isolator for confining and transporting human beings in a sterile atmosphere comprising a tight enclosure; a first fan for providing a forced fresh air circulation through an absolute inlet filter and an absolute outlet filter for ventilating the enclosure, the first fan having a first preselected constant rotational speed; means for placing the first fan in an operative state or in an inoperative state; means adapted for rapid transfer of objects from the exterior to the interior of said enclosure; intervention means enabling functions to be performed within said enclosure while maintaining said sterile atmosphere, a portion of said intervention means forming an integral part of a wall of said enclosure; air recycling branch means interposed between said inlet filter and said outlet filter, said branch means containing a second fan having a second preselected constant rotational speed and variable temperature heating means automatically limited to a predetermined maximum temperature, said second fan and said heating means being operable to controllably reheat and recycle a portion of said fresh air circulation at a predetermined reference temperature; battery means capable of supplying all of the energy required by the isolator; and control means for regulating the temperature of the heating means to obtain an internal temperature within the enclosure equal to the reference temperature, the control means comprising a basic control portion responsive to the variation between an external temperature and the reference temperature and to the operative or inoperative state of the first fan for providing a first signal for controlling the heating means, and a complementary fine control portion responsive to the variation between the internal temperature and the reference temperature for providing a second signal for controlling the heating means.

2. The isolator of claim 1, wherein said heating means comprises power transistors through which flows a current regulated by said basic control portion and said complementary fine control portion, the power transistors being mounted on members having cooling blades extending into said air recycling branch means such that the heat produced by the passage of said current through said power transistors is dissipated in said portion of said fresh air circulation in the air recycling branch means.

3. An isolator according to claim 2, wherein the heating means comprises temperature-variable thermistors for automatically reducing the current in the power transistors so as to limit the maximum temperature of the power transistors to a value in the range of approximately 80° to 120° C., said maximum temperature being said predetermined maximum temperature.

4. An isolator according to claim 1 wherein the heating means comprises power transistors through which flows a current regulated by the control means, the power transistors being mounted on heat-dissipating plates having cooled blades immersed in the air recycling branch means.

5. The isolator of claim 1, wherein said isolator is formed to be transported in a vehicle, and wherein said battery means comprises means for supplying said energy to the isolator from an electrical system of the vehicle.

6. The isolator of claim 1, wherein said control means comprises means for sensing the internal temperature, the reference temperature, and the external temperature, and an electrical circuit having a first circuit portion responsive to the difference between the external temperature and the reference temperature for producing said first signal, a second circuit portion responsive to the difference between the internal temperature and the reference temperature for producing said second signal, said first and second circuit portions being, respectively, said basic control portion and said complementary fine control portion of the control means, and means for summing the first and second signals to provide a temperature regulating signal to the heating means.

7. The isolator of claim 1, wherein said first fan has an air flow capacity of the order of one-third the air flow capacity of the second fan.

8. The isolator of claim 1, wherein said enclosure comprises an incubator for confining and transporting infant human beings.

* * * * *